United States Patent [19]

Date et al.

[11] 4,283,610

[45] Aug. 11, 1981

[54] OPERATOR FOR A CIRCUIT INTERRUPTER AND DISCONNECT SWITCH COMBINATION

[75] Inventors: Kazuo H. Date, Torrance, Calif.; Ronald A. Wainio, Milwaukee, Wis.

[73] Assignee: McGraw-Edison Company, Rolling Meadows, Ill.

[21] Appl. No.: 19,059

[22] Filed: Mar. 9, 1979

[51] Int. Cl.[3] ..... H01H 33/12; H01H 9/38

[52] U.S. Cl. ..... 200/146 R; 200/153 G; 200/153 J

[58] Field of Search ..... 200/146 R, 153 J, 153 G

[56] References Cited

U.S. PATENT DOCUMENTS

| | | | |
|---|---|---|---|
| 4,105,878 | 8/1978 | Date et al. | 200/146 R |
| 4,220,837 | 9/1980 | Bice | 200/146 R |

*Primary Examiner*—Robert S. Macon

*Attorney, Agent, or Firm*—Jon Carl Gealow; Thomas E. McDonald

[57] ABSTRACT

A manual operator for a series-connected circuit interrupter and disconnect combination mounted within a switch gearing closure, which includes an external operating handle affixed to a common operating shaft for the interrupter and the disconnect, which is rotatable about its axis between a closed position and an open position. A quick make, quick break, interrupter operating mechanism includes a manual operating shaft which is rotatable about its axis between a closed position and an open position. An operating rod has one end pivotally connected to a lever affixed to the common shaft and an opposite end pivotally connected to a lever affixed to the interrupter operator shaft, so that when the common shaft is rotated between its closed and open positions, the interrupter operating shaft is correspondingly rotated between its closed and open positions. The operating rod is held in a toggled position at both its closed and open positions by a spring connected between the rod and the switchgear enclosure. A disconnect operating shaft which is rotatable about its axis between a closed position and an open position, is connected by a "lost motion" linkage to be operated by the interrupter operating shaft, wherein, when the interrupter operating shaft is rotated from its open position, the disconnect shaft is rotated from its open position only after the interrupter has opened, and when the interrupter operating shaft is rotated from its closed position, the disconnect will close before the interrupter closes.

9 Claims, 15 Drawing Figures

OPERATOR FOR A CIRCUIT INTERRUPTER AND DISCONNECT SWITCH COMBINATION

BACKGROUND OF THE INVENTION

1. Field of the Invention

The invention relates generally to operating mechanisms of high voltage switchgear, and, more particularly to operating mechanisms for circuit interrupter and disconnect switch combinations.

2. Prior Art

U.S. Pat. No. 4,105,878, issued Aug. 8, 1978 to Date et al, discloses a combination vacuum interrupter and visible break disconnect switch in which the interruper is electrically connected in series with the disconnect. The interrupter is closed manually, and is tripped either manually or automatically on overcurrent or undervoltage line conditions by a quick make, quick break, trip free operating mechanism. The disconnect is manually opened or closed by a separate operating mechanism, which is mechanically interlocked with the interrupter operating mechanism so that the disconnect cannot be opened when the interrupter is closed, or the interrupter cannot be closed when the disconnect is open. The interrupter is open or closed by rotating a manual interrupter operating handle affixed to a manual operating shaft extending from one side of the interrupter and disconnect combination. The disconnect switch is manually opened or closed by rotating a disconnect operating handle affixed to the disconnect operating shaft, which also extends from one side of the interrupter and disconnect combination.

Since the circuit interrupter of an interrupter and disconnect series combination must generally be operated each time the disconnect switch of the combination is operated to prevent the disconnect switch from opening or closing an energized line, a single handle operator for manually operating both the circuit interrupter and the disconnect switch of an interrupter and disconnect series combination, is advantageous.

In the past, where a circuit interrupter and disconnect switch combination was mounted in a switchgear enclosure having a window in the front panel thereof through which the position of the disconnect switch can be observed, a manual operator, which included an interrupter manual operating handle and a disconnect manual operating handle and which is described hereinafter in connection with FIGS. 13–15, was mounted on the front panel of the switchgear enclosure. Such a front mounted operator assembly permits an operator to observe the position of the disconnect switch while it is being manually opened or closed. Also, the use of a front mounted manual operator permits the circuit interrupter and disconnect switch combination to be mounted within one section of a metalclad switchgear assembly in which other sections of the switchgear assembly are disposed on either or both sides of the section containing the interrupter and disconnect combination. Therefore, a single handle operator, mounted on the front panel of the switchgear enclosure, for manually operating both the circuit interrupter and the disconnect switch of an interrupter and disconnect switch combination mounted within the switchgear enclosure, is very desirable.

SUMMARY OF THE INVENTION

Therefore, it an object of the invention to provide a single handle manual operator for a circuit interrupter and disconnect switch combination, in which the circuit interrupter is always opened before the disconnect switch is opened, and the disconnect switch is always closed before the circuit interrupter is closed.

It is another object of the invention to provide a single handle manual operator, mounted on a front exterior surface of a metal clad switchgear enclosure, for a high voltage circuit interrupter and disconnect switch combination contained within the switchgear enclosure.

It is still another object of the invention to provide a circuit interrupter and disconnect switch combination having a mechanical interlock for preventing the disconnect switch from being opened until the interrupting contacts of the circuit interrupter have been fully opened.

A circuit interrupter and disconnect combination, similar to that disclosed in the above referenced U.S. Pat. No. 4,105,878, is mounted within a metalclad switchgear enclosure. The operating mechanism for the circuit interrupter of the interrupter and disconnect switch combination includes an interrupter manual operating shaft which extends parallel to the front panel of the switchgear enclosure. The interrupter manual operating shaft is rotatable through an arc of approximately 100 degrees between an open position and a closed position, to manually open or close the circuit interrupter. The manual operator assembly for the interrupter and disconnect switch combination includes an operator handle assembly mounted to the front panel of the switchgear enclosure. The operating handle assembly includes a second operating shaft, having a longitudinal axis, which is rotatably mounted to the switchgear enclosure in spaced parallel arrangement with the interrupter manual operating shaft. An interrupter manual operating handle is affixed to the second operating shaft to allow an operator to rotate the second shaft about its longitudinal axis through an arc of approximately 180 degrees in one direction from an open position to a closed position, and to rotate the second shaft about its longitudinal axis in an opposite direction from its closed position to its open position. The closed position of the second shaft is determined by a handle stop affixed to the switchgear enclosure, against which the manual operating handle abuts when it is rotated to its closed position, similarly, the open position of the second operating shaft is determined by another handle stop, against which the manual operating handle abuts when it is moved to its open position.

The second operating shaft is mechanically connected to operate the interrupter manual operating shaft by a first lever affixed to the interrupter manual operating shaft, a second lever affixed to the second operating shaft, and an operating rod connected between the first and second levers. The operating rod has a first end pivotally connected to the first lever for rotation about a first pivot axis of the operating rod, and a second end pivotally connected to the second lever for rotation about a second pivot axis of the operating rod. When the second operating shaft is disposed in its open position, the interruper manual operating shaft is disposed in its open position and the operating rod is disposed in a retracted toggle position at which the longitudinal axis of the second operating shaft falls on a straight line between the first and second pivot axes of the operating rod. When the second operating shaft is rotated from its open position to its closed position, the interrupter manual operating shaft is rotated from its open position to its closed position, and the operating rod is moved from its retracted toggle position to an extended toggle position, at which the second pivot axis of the operating rod falls on a straight line between the longitudinal axes of the second operating shaft and the first pivot axis of the operating rod.

The manual operator assembly also includes a tension spring, having an upper end connected to the second end of the operating rod and a lower end connected to the switchgear enclosure support structure, for exerting a force on the operating rod to maintain the operating rod at either its extended toggle position or its retracted toggle position, and thus maintain the second operating shaft in either its open position or its closed position. When the second operating shaft is rotated from either its open position or its closed position, the second end of the operating rod will be moved upward. Consequently, the force exerted by the tension spring on the operating rod will increase, as the second shaft is rotated between its open and closed positions, to a maximum value of which the second operating shaft is approximately halfway between its opened and closed positions.

The interrupter and disconnect switch combination also includes a disconnect switch operating mechanism having a disconnect operating shaft which is rotatably mounted to the support structure for rotation about its longitudinal axis between a closed position and an open position, in spaced parallel arrangement with the interrupter manual operating shaft. In one embodiment of the invention, the interrupter manual operating shaft is connected to operate the disconnect operating shaft by a mechanical linkage which includes a third lever affixed to the interrupter manual operating shaft, a fourth lever affixed to the disconnect operating shaft, and a driving link connected between the third and fourth lever. The driving link has a first end which is pivotably connected to the fourth lever, and an opposite side end which has an elongated opening, or slot, formed therethrough. A pivot pin, which is carried by the third lever and extends through the slot, is positioned against the outer end of the slot when the interrupter operating shaft and the disconnect operating shaft are disposed in their open positions, and against the inner end of the slot when the interrupter manual operating and the disconnect operating shaft are disposed in their closed position. Also, the linkage is designed so that, when the interrupter manual operating shaft is rotated to its closed position, the driving link is moved to an overtoggled position. The disconnect switch is fully closed before the driving link reaches its toggled position, and remains closed as the driving link is moved over its toggle position into its closed position.

When the interrupter manual operating shaft is rotated from its open position towards its closed position, the vacuum interrupter is not closed until the interrupter manual operating shaft has been rotated to a position near its closed position at which the closing spring is fully charged. Also, when the interrupter manual operating handle is moved from its closed position towards its open position, the vacuum interrupter is tripped after the interrupter manual operating shaft has been rotated only a few degrees away from its closed position, as described in detail in the aboved referenced U.S. Pat. No. 4,105,878.

When the interrupter manual operating shaft is rotated from its open position towards its closed position, the pivot pin carried by the third lever tranverses the length of the slot and abuts against the inner end of the slot to initiate the rotation of the disconnect operating shaft from its open position towards its closed position. The pivot pin remains in abutment with the inner end of the slot until the driving link has been moved to its toggle position. As the interrupter manual operating shaft is rotated towards its closed position, first the disconnect switch is closed, and then the vacuum interrupter is closed as the driving link is moved over its toggle position to its closed position. When the interrupter manual operating shaft is rotated from its closed position towards its open position, the vacuum interrupter is tripped before the driving link is moved over its toggle position and the pivot pin tranverses the link to the slot and abuts against the outer end of the slot to initiate rotation of the disconnect operating shaft from its closed position towards its open position. Thus, when the interrupter operating shaft is rotated from its closed to its closed position, the series circuit through the vacuum interrupter and the disconnect switch is opened by the vacuum interrupter before the disconnect switch which opens, and, when the interrupter manual operating shaft is rotated from its open position to its closed position, the disconnect switch closes before the vacuum interrupter closes to energize the electric circuit. This assures that the disconnect switch can never be operated to energize or deenergize the electric circuit.

Another embodiment of the invention includes a mechanical interlock assembly to prevent opening of the disconnect switch unless the vacuum interrupter is fully and completely open. The mechanical interlock assembly includes an interlock lever affixed to the disconnect operation shaft and a cam latch pivotably mounted to the switchgear support frame for rotation in the same plane as the interlock lever.

The cam latch is mechanically linked to the interrupter operating shaft, so that it extends into the path of travel of the interlock lever when the interrupter operating shaft is in its closed position, and is rotated out of the path of travel of the interlock lever only when the interrupter operating shaft has been rotated to its fully open position. The cam latch is spaced from the interlock lever to allow the vacuum interrupter to be tripped when the interrupter manual operating shaft is rotated from its closed position towards its open position before the interlock lever abuts against the cam latch. During a normal manual opening in an operation of the vacuum interrupter and disconnect switch combination, as the interrupter manual operating shaft is rotated from its closed position towards its open position, the vacuum interrupter is first tripped, the cam latch is rotated out of the path of the interlock lever to allow the interlock lever to rotate pass the cam latch to the position of the disconnect operating shaft at which the disconnect switch starts to open. If for any reason the vacuum interrupter contacts do not fully open when the vacuum interrupter is tripped, the interlock lever will abut against the cam latch to prevent further rotation of the disconnect operating shaft before the disconnect operating shaft has been rotated sufficiently to open the disconnect switch.

These an other objects of the present invention will become more apparent from the following detailed description and from study of the appended drawing herein.

DESCRIPTION OF PREFERRED EMBODIMENTS

Figure 1:
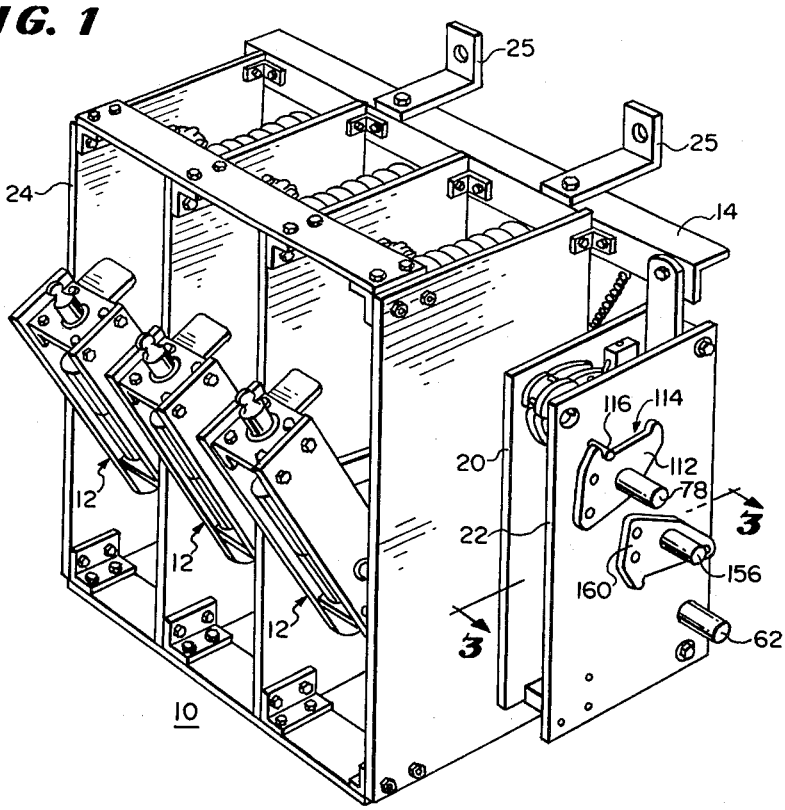
FIG. 1 is a perspective view of a three phase vacuum interrupter and disconnect switch combination.
Figure 5:
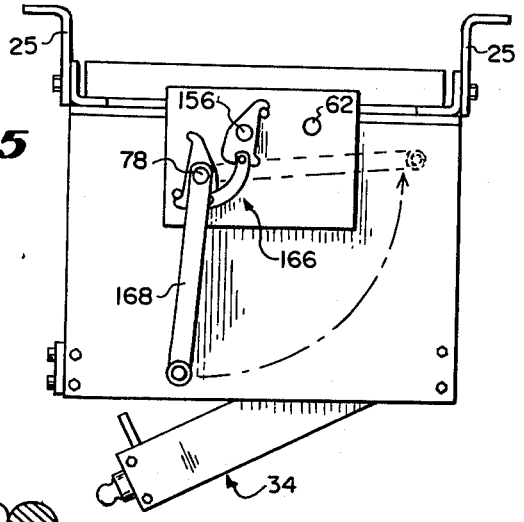
FIG. 5 is a side view of a vacuum interrupter and disconnect switch combination, which is mounted horizontally with the disconnect opening downward, and which includes a single handle, side mounted manual operator assembly, according to the invention.

FIG. 1, shows a three pole, vacuum interrupter and disconnect switch combination 10, similar to that disclosed in in the above-referenced U.S. Pat. No. 4,105,878 which is included herein by reference. The interrupter and disconnect switch combination 10 includes three single pole, vacuum interrupter and disconnect switch assemblies 12, mounted on a common support frame 14, which are gangoperated by interrupter and disconnect operating mechanisms 16, 18, carried by spaced-apart support plates 20, 22 of the frame 14. Insulating barrier plates 24, also mounted to the support frame 14, are disposed between adjacent assemblies 12 and at both ends of the ganged assemblies 12. Four mounting brackets 25, two of which are shown in FIG. 1, are affixed to the support frame 14 for mounting the vacuum interrupter and disconnect switch combination 10 either vertically as shown in FIG. 1, or horizontally as shown in FIG. 5.

Figure 2:
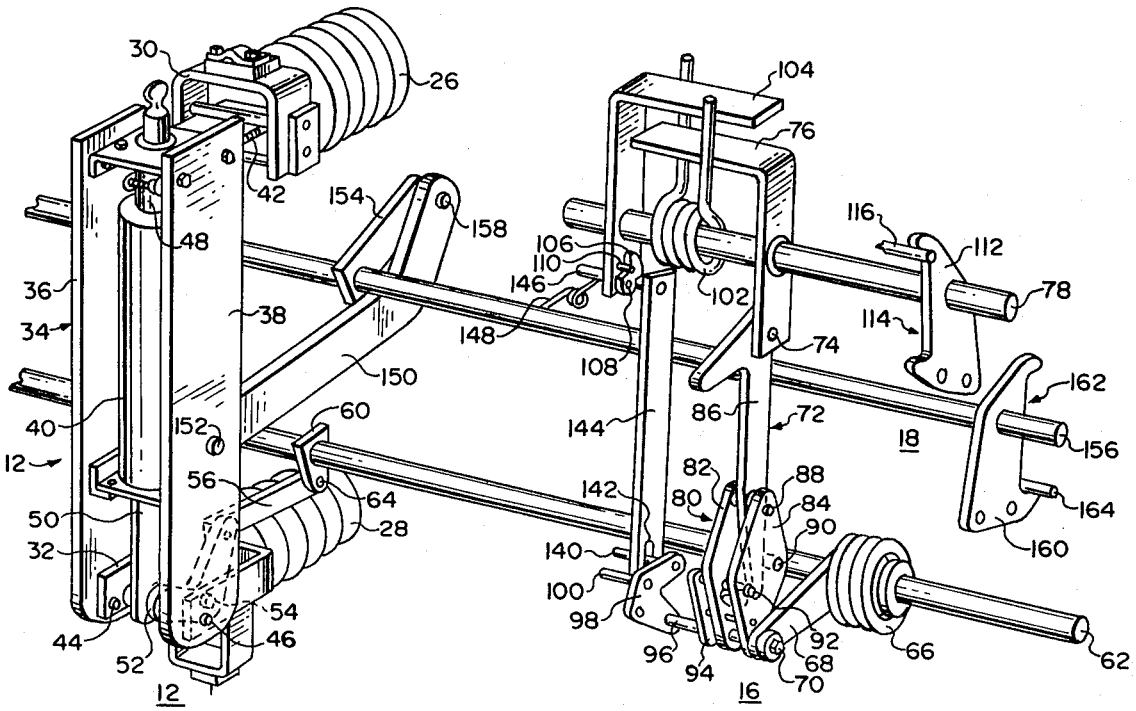
FIG. 2 is a perspective simplified view of the vacuum interrupter and disconnect switch combination of FIG. 1, showing a single vacuum interrupter and disconnect switch combination assembly, and the main operating members of the interrupter and disconnect operating mechanisms.

As best shown in FIG. 2, each vacuum interrupter and disconnect switch assembly 12 includes two, spaced apart, electrical insulator support members 26, 28, each mounted at one end to the support frame 14. A disconnect switch stationary contact assembly 30, is mounted on the opposite end of the insulator 26. An electrically conductive terminal bracket 32, is mounted on the opposite end of the insulator 28. The disconnect switch stationary contact assembly 30 and the bracket 32 are connected by suitable conductors (not shown) to respective source and load sections of an electric power distribution line.

A pivotable disconnect switch assembly 34 of the interrupter and disconnect switch assembly 12 includes two elongated insulating support members, 36 and 38, which are spaced apart for mounting therebetween a vacuum interrupter 40 and a disconnect switch movable contact 42. The disconnect switch movable contact 42 is affixed between the upper ends of the insulating support members 36 and 38. The lower ends of the insulating support members 36 and 38 are pivotably connected by axially aligned pins 44 and 46 respectively to the bracket 32 for pivotal movement of the disconnect switch assembly 34 about the pins 44 and 46 between a closed position wherein the disconnect switch movable contact 42 engages the disconnect switch stationary contact 30, and an open position wherein the contacts 42 and 30 are disengaged and suitably separated.

The vacuum interrupter 40 includes a stationary contact rod 48 which is affixed to the disconnect switch movable contact 42, and a movable contact rod 50 which is movable along the axis of the vacuum interrupter 40 between a closed position where it engages a stationary contact rod 48, and an open, or tripped, position where it is disengaged and separated by a suitable distance from the stationary contact rod 48. The free end of the interrupter movable contact rod 50 is pivotably connected to one end of an electrically conductive bell crank 52. The bell crank 52 is pivotably mounted to the bracket 32 by a fulcrum pin 54. The vacuum interrupter 40 and the bell crank 52 are disposed so that when the vacuum interrupter 40 is in its tripped position, the pivotable axis of the movable contact rod 50 about the bell crank 52 coincides with the pivotable axis of the support plates 36 and 38 about the bracket 32.

The other arm of the bell crank 52 is pivotably connected to one end of an insulating connecting link 56 by a pin 58. The opposite end of the connecting link 56 is pivotably connected to a crank arm 60 of an interrupter operating shaft 62 by a pin 64. An opening torsion spring 66, connected between the interrupter operating shaft 62 and the frame 14, exerts a force on the interrupter operating shaft 62 to maintain the vacuum interrupter 40 in its open position.

A lever arm 68 of the interrupter operating shaft 62 is pivotably connected by a pin 70 to one end of a conventional toggle latch mechanism 72, shown in its latched, fully extended position in FIG. 2. The opposite end of this toggle latch mechanism 72 is pivotably connected by a pin 74 to a latchable end of an L-shaped latch lever 76, which is pivotably mounted on an interrupter manual operating shaft 78, and which is latchable in either a closed or tripped position as explained hereinafter.

The toggle latch mechanism 72 is similar to the toggle latch mechanism described in the above-referenced U.S. Pat. No. 4,105,878, and includes a latching assembly 80 of two spaced apart plates 82 and 84 pivotably connected at one end to the lever arm 68 by the pin 70. At an opposite end of the latching assembly 80, a latch member 86 is pivotably connected at a medial portion thereof between the two plates 82, 84 by a pin 88. One end of the latch member 86 is pivotably connected to the lever 76 by the pin 74 so that when the lever 76 is rotated upward in a clockwise direction as seen from the right side in FIG. 2, the toggle latch assembly 72 is extended until the opposite end of the latch member 86 strikes against a spacing pin 90 connected between the plates 82, 84. The spacing pin 90 prevents the toggle mechanism 72 from being completely extending to its toggle point position, that is, the position at which the pivot pins 70, 74 and 88 are positioned along a straight line. The latching assembly 80 also includes a spring-loaded latch pin 92 pivotably held by the plates 82, 84. The medial portion of this latch pin 92 between the plates 82 84 is shaped as a half-cylinder, and is spring-held in such a position that the end of the latch member 86 will press against and rotate the flat surface of the half cylinder as it is moved toward its extending position.

After the end of the latch member 86 has traversed the latch pin 92, the latch pin 92 is spring-returned to its normal position, and the latch member 86 is held in its extended position by the cylindrical surface of the latch pin 92 until an unlatching lever 94 affixed to one end of the latch pin 92 is rotated to free the latch member 86. Then, if the latch lever 76 is latched in its closed position, the toggle mechanism 72 will be quickly collapsed and the vacuum interrupter 40 will be tripped by the force exerted on it by the opening spring 66.

When the disconnect switch assembly 34 and the vacuum interrupter 40 are closed, the unlatching lever 94 of the toggle mechanism 72 is positioned adjacent a pin 96 of a trip lever 98, which is pivotably mounted to the support frame 22 by a pin 100. The trip lever 98 can be rotated to unlatch the toggle mechanism 72 by rotating the interrupter manual operating shaft 78 in a clockwise direction, as explained hereinafter. Also, the trip lever 98 can be rotated to unlatch the toggle mechanism 72 by the operation of overcurrent of undervoltage relays (not shown), as described in the above-referenced U.S. Pat. No. 4,105,878.

An opposite end of the L-shaped latch lever 76 extends longitudinally along the interrupter manual operating shaft 78 between the two ends of a closing torsion spring 102 disposed about the interrupter manual operating shaft 78. An L-shaped driving member 104, affixed at one end to the interrupter manual operating shaft 78, has an opposite end which also extends longitudinally along the interrupter manual operating shaft 78 between the two ends of the closing spring 102. Thus, when the latch lever 76 is not latched in a fixed position, rotational movement of the interrupter manual operating shaft 78 is transmitted to the latch lever 76 by the driving 104 through the closing spring 102. A trip cam 106 is pivotably connected to the driving member 104 by a pin 108. The driving member 104 also includes a stop pin 110 which limits the rotation of the trip cam 106. The trip cam 106 operates to trip the vacuum interrupter 40 when the interrupter manual operating shaft 78 is rotated from its closed position toward its open position, as explained hereinafter.

A cam stop plate 112, affixed to the interrupter manual operating shaft 78, includes a slot 114. A positioning pin 116, affixed to the support plate 20, extends into the slot 114 to limit the rotation of the interrupter manual operating shaft 78 and define its open and closed positions, as shown in FIG. 1 and FIG. 2 respectively.

Figure 3:
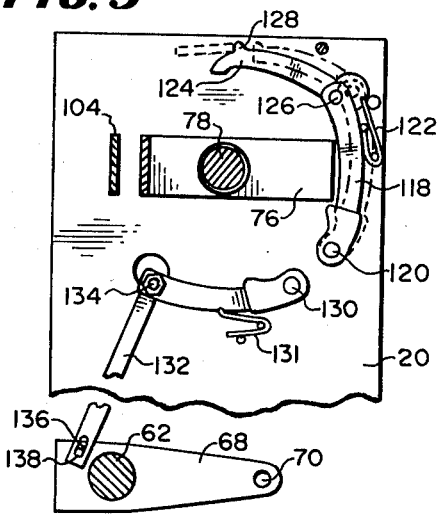
FIG. 3 is a partial cross-sectional view of the interrupter operating mechanisms, taken along the line 3—3 of FIG. 1, showing the detent members holding the interrupter mechanism latch lever in its opened position.

Referring now to FIG. 3, the latchable end of the latch lever 76 is shown latched in its open position by a detent member 118 which is pivotable about a pin 120 of the support plate 20 and includes a spring 122 for normally positioning the detent member 118 in its latching position. However, the detent member 118 is shaped so that as the latch lever 76 is rotated counterclockwise, as seen in FIG. 3, from its closed position to its open position, it will ride over the latching portion of the detent member 118 by rotating the detent member 118 clockwise against its positioning spring 122. When the end of the latch lever 76 has cleared the latching portion of the detent member 118, the detent member 118 will be spring-returned to its latching position, and will hold the latch lever 76 in its open position until the detent member 118 is rotated clockwise to release it.

A detent release lever 124, pivotable about a pin 126 affixed to the free end of the detent member 118, is spring-loaded to position a raised portion, or spur 128, of the lever 124 in the path of the driving member 104 of the interrupter manual operating shaft 78 as the interrupter manual operating shaft 78 is rotated from its open position to its closed position. When the driving member 104 contacts the spur 128 of the release lever 124 near the end of its path of travel from its open position to its closed position, the release lever 124 is pushed against the end of the detent member 118 to rotate the detent member 118 clockwise about its pivot pin 126 and release the latch lever 76, as shown by dashed lines in FIG. 3.

As the interrupter manual operating shaft 78 is moved from its open position to its closed position, the closing spring 102 is charged, since one end of the closing spring 102 is rotated with the driving member 104 of the interrupter manual operating shaft 78 and the other end of the closing spring 102 is held stationary by the latch lever 76. When the driving member 104 strikes the release lever 124 and unlatches the latch lever 76, the fully-charged closing spring 102 quickly rotates the latch lever 76 to its closed position. Referring again to FIG. 2, the toggle mechanism 72, which had been previously fully extended and latched by the interrupter manual operating shaft 78 in its open position, is acted upon by the latch lever 76 to quickly close the vacuum interrupter 40, and at the same time, to charge the opening spring 66 for the next interrupter opening operation.

Figure 4:
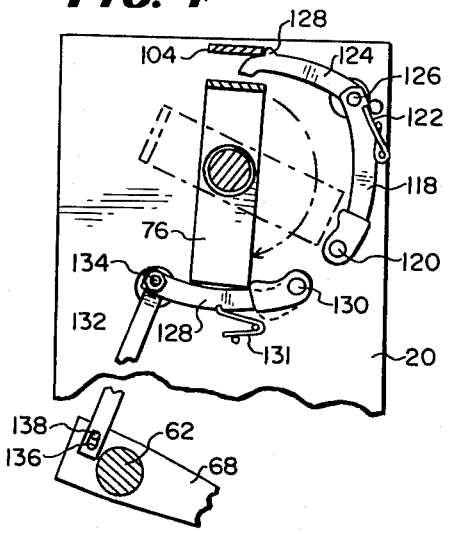
FIG. 4 is another partial cross-sectional view of the interrupter operating mechanism similar to FIG. 3 except showing the detent members holding the latch lever in its closed position.

When the latch lever 76 is released from its open position as the interrupter manual operating shaft 78 is rotated to its closed position, it is quickly rotated clockwise, as seen in FIG. 4, and its end slides over another detent member 128, similar to the detent member 118, which is pivotable about a pin 130 of the support plate 20, and includes a spring 131 for normally positioning the detent member 128 in its latching position. After the latch lever 76 reaches its closed position, it is held in this position until the detent member 128 is rotated counterclockwise about its A detent releasing link 132 is pivotable at one end about a pin 134 which is disposed at the free end of the detent member 128. The opposite end of the detent releasing link 132 defines a slot 136. into which a pin 138 extends. This pin 138 is affixed to the lever arm 68 of the interrupter operating shaft 62, so that, when the vacuum interrupter 40 is tripped by unlatching the toggle mechanism 72, the detent member 128 will be rotated counterclockwise by the link 132 to release the latch lever 76 so that it can be subsequently reset for a reclosing operation.

Both the pin 126 of the detent member 118 and the pin 134 of the detent member 128 extend into adjacent openings in the support plate 20, to thereby limit the travel of the detent members 118, 128. Consequently, the end of the detent releasing link 132 is slotted rather than directly pivoted about the pin 132 to limit the travel of the detent releasing link 132 to that of the pin 134 within the opening of the support plate 20.

Referring again to FIG. 2, a pin 140, affixed to an opposite end of the trip lever 98, is disposed within a slot 142 at one end of a link 144. A pin 146, affixed to the opposite end of the link 144, extends into an opening in the support plate 22 which serves to limit the travel of the link 144. A spring 144 connected between the pin 146 and the support plate 22 normally positions the link 144 in its nontripping position. When the driving member 104 of the interrupter manual operating shaft 78 is rotated from its trip position to its closed position, the trip cam 106 will be rotated about its pivot pin 108 and traverse the pin 146 without moving the pin 146. However, when the driving member 104 is rotated in the reverse direction from its closed postion to its trip position, the pin 110 prevents the trip cam 106 from rolling around and over the pin 146, and the trip cam 106 exerts a force against the pin 146 to move the link 144 against the pin 140 of the trip lever 98, and rotate the trip lever 98 in a clockwise direction to trip the vacuum interrupter 40.

A medial portion of the disconnect switch assembly 34 is pivotably connected to one end of an electrically insulating, connecting link 150 of the disconnect switch operating mechanism 18 by a pivot pin 152. An opposite end of the connecting link 150 is pivotably connected to a crank arm 154 of a manual disconnect operating shaft 156 by a pivot pin 158. The manual disconnect operating shaft 156 is rotatable about its axis between an open position and a closed position.

A cam stop plate 160, affixed to the manual disconnect operation shaft 156, includes a slot 162. A positioning pin 164, affixed to the support plate 20, extends into the slot 162, to limit the rotation of the manual disconnect operating shaft 156 and define its open and closed positions, as shown in FIG. 1 and FIG. 2 respectively.

When the vacuum interrupter 40 and the disconnect switch assembly 34 are both in the open position, rotation of the manual disconnect operating shaft 156 and the crank arm 154 in a counterclockwise direction causes the connecting link 150 to rotate over its toggle point to its closed position. The toggle point position of the connecting link 150 is that position of the connecting link 150 at which the pivot pins 152, 158, and the manual disconnect operating shaft 156 are aligned. As the manual disconnect operating shaft 156 is rotated counterclockwise from its open position to its closed position, the disconnect switch assembly 34 is rotated clockwise from its open position to its closed position.

When the vacuum interrupter 40 is open and the disconnect switch assembly 34 closed, the manual disconnect operating shaft 156 must be rotated clockwise for at least twice the angular displacement between the closed position of the manual disconnect operating shaft 156 and the position of the shaft 156 at which the connecting link 150 is disposed in its toggle position before the disconnect switch moving contact 42 starts to disengage from the disconnect switch stationary contact 30.

The vacuum interrupter and disconnect switch combination 10, shown in FIG. 5, is mounted horizonally with the disconnect switch assembly 34 opening downward. A manual operator assembly 166, described in detail hereinafter, is connected to the interrupter and disconnect operating mechanisms 16, 18, to open or close the disconnect switch assemblies 34 and the vacuum interrupters 40. A manual operating handle 168, which is affixed to the interrupter manual operating shaft 78, is pivotable through an arc of approximately 100 degrees determined by the cam stop plate 112, between an open position shown in FIG. 5, and a closed position, also shown in FIG. 5 by dashed lines.

Figure 6:
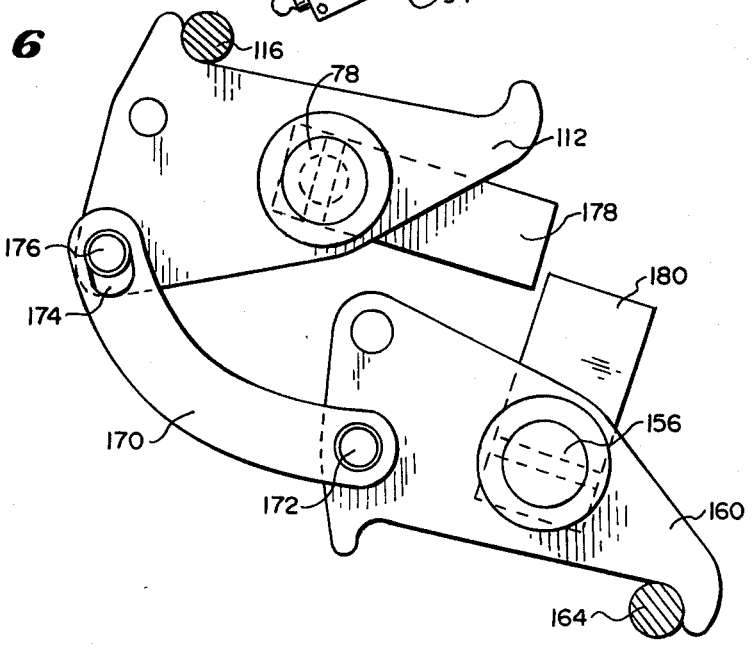
FIG. 6 is a side view of the single handle manual operating assembly, shown in its open position.
Figure 7:
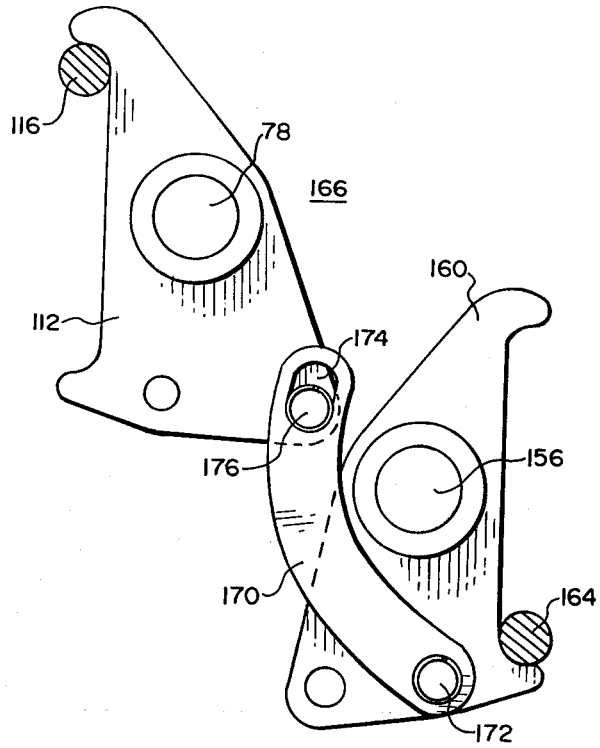
FIG. 7 is a side view of the single handle manual operator assembly, shown in its closed position.

The manual operator assembly 166 can also be used with the vertically mounted vacuum interrupter and disconnect switch combination 10 of FIG. 1. As shown in FIGS. 6 and 7, the manual operator assembly 166 includes a driving link 170 which is pivotably attached to the cam stop plate 160 by a pin 172. The opposite end of the driving link 170 includes a slot 174 formed therethrough. The cam stop plate 112 is pivotably and slidably attached to the driving link 170 by a pin 176, which is affixed to the cam stop plate 112 and which extends through the slot 174 of the driving link 170. The manual operating assembly 166 also includes two latch members 178 and 180. The latch member 178 has one end which is affixed to the interrupter manual operating shaft 78 and an opposite end which extends orthogonally outward from the interrupter manual operating shaft 78. The latch member 180 has one end which is affixed to the manual disconnect operating shaft 156 and an opposite end which extends orthogonally outward from the manual disconnect operating shaft 156 in the same plane as the latch member 178. When the interrupter manual operating shaft 78 is in its open position, the free end of the latch member 178 extends in the path of rotation of the latch member 180 in close proximity to one side of the latch member 80, to thus lock the manual disconnect operating shaft 156 in the open position, as shown in FIG. 6. Also, when the interrupter manual operating shaft 78 is in its open position, the pin 176 is disposed at the outer end of the slot 174. When the interrupter manual operating shaft 78 is rotated from its open position towards its closed position, the pin 176 does not exert any force on the driving link 170 until it has been rotated so that it presses against the inner side of the slot 174. Before the pin 176 has been rotated to the inner side of the slot 174, the free end of the latch member 178 has been rotated counterclockwise out of the path of travel of the latch member 180 to thus unlock the manual disconnect operating shaft 156 so that the shaft 156 can be rotated by the driving link 170 as the interrupter manual operating shaft 78 is further rotated counterclockwise towards its closed position, shown in FIG. 7.

As the interrupter manual operating shaft 78 is rotated counterclockwise towards its closed position, the closing spring 66 is charged, as explained above, and the manual disconnect operating shaft 156 is rotated counterclockwise until each disconnect switch moving contact 42 is fully engaged with its associated disconnect switch stationary contact 30. As the interrupter manual operating shaft 78 is further rotated counterclockwise, the connecting link 150 will be moved over its toggle position to its closed position before the driving link 170 has been moved to its toggle position at which the pivot pins 172 and 176 are aligned with the interrupter manual operating shaft 78. During still further counterclockwise rotation of the interrupter manual operating shaft 78 into its closed position, the driving link 170 is moved over and beyond its toggle point to its closed position. At the same time, the latch lever 76 is unlatched to allow the fully charged closing spring 102 to quickly close the vacuum interrupters 40 and charge the opening spring 66 for the next interrupter opening operation, as explained in detail above. Thus, overtoggling of both the driving link 170 and the connecting link 150 assures that the disconnect switch assemblies 34 will always be fully closed before the vacuum interrupters 40 are closed.

Figure 8:
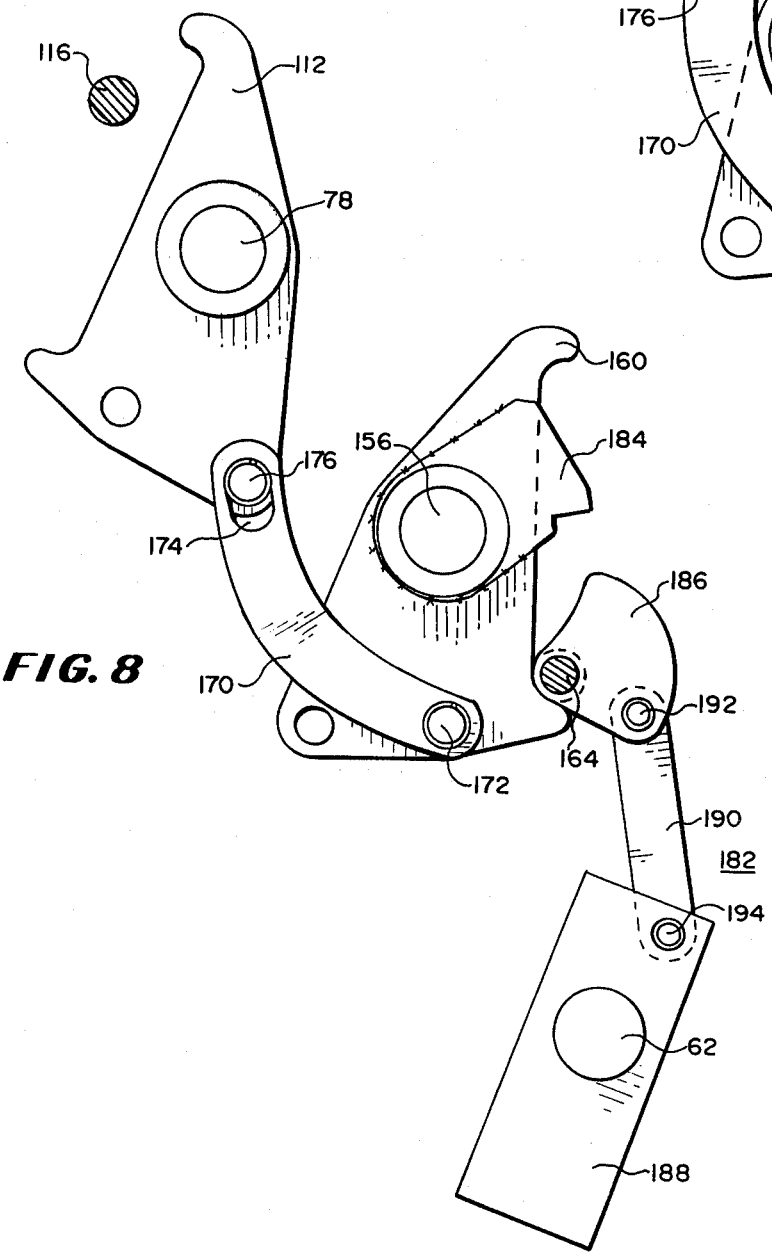
FIG. 8 and 9 are simplified side views of the single handle manual operator assembly and a mechanical interlock between the disconnect and interrupter operating shafts, wherein the interrupter operating shaft is shown in its open position in FIG. 8 and in its closed position in FIG. 9.

When the interrupter manual operating shaft 78 is rotated clockwise from its closed position, shown in FIG. 7, towards its open position, shown in FIG. 6, the vacuum interrupters 40 will be tripped after the interrupter manual operating shaft 78 has been rotated only a few degrees from its closed position. However, the disconnect switch assemblies 34 will not begin to move from the closed position until the interrupter manual operating shaft 78 has been rotated through approximately half of its angular rotation between its closed and open positions. When the interrupter manual operating shaft 78 is rotated from its closed position, the driving link 170 is moved through its toggle position and the pin 176 is moved within the slot 174 until it is adjacent the outer end of the slot 174, as shown in FIG. 8. Further rotation of the interrupter manual operating shaft 78 towards its open position will cause the cam stop plate 160 and the manual disconnect operating shaft 156 to rotate in a clockwise direction. However, the disconnect switch assemblies 34 will not start to move until the connecting links 150 has been moved over their toggle points. Then, during the last half of the angular rotation of the interrupter manual operating shaft 78 between its closed and open positions, the disconnect assemblies 34 will be rotated about their associated pivot pins 44, 46 to the open position. Thus, the overtoggle operation of the connecting link 150 and the driving link 170 and the lost motion produced by the sliding action of the pin 176 within the slot 174, assures that the vacuum interrupters 40 will always trip and open the circuit before the disconnect assemblies 34 start to open.

Figure 9:
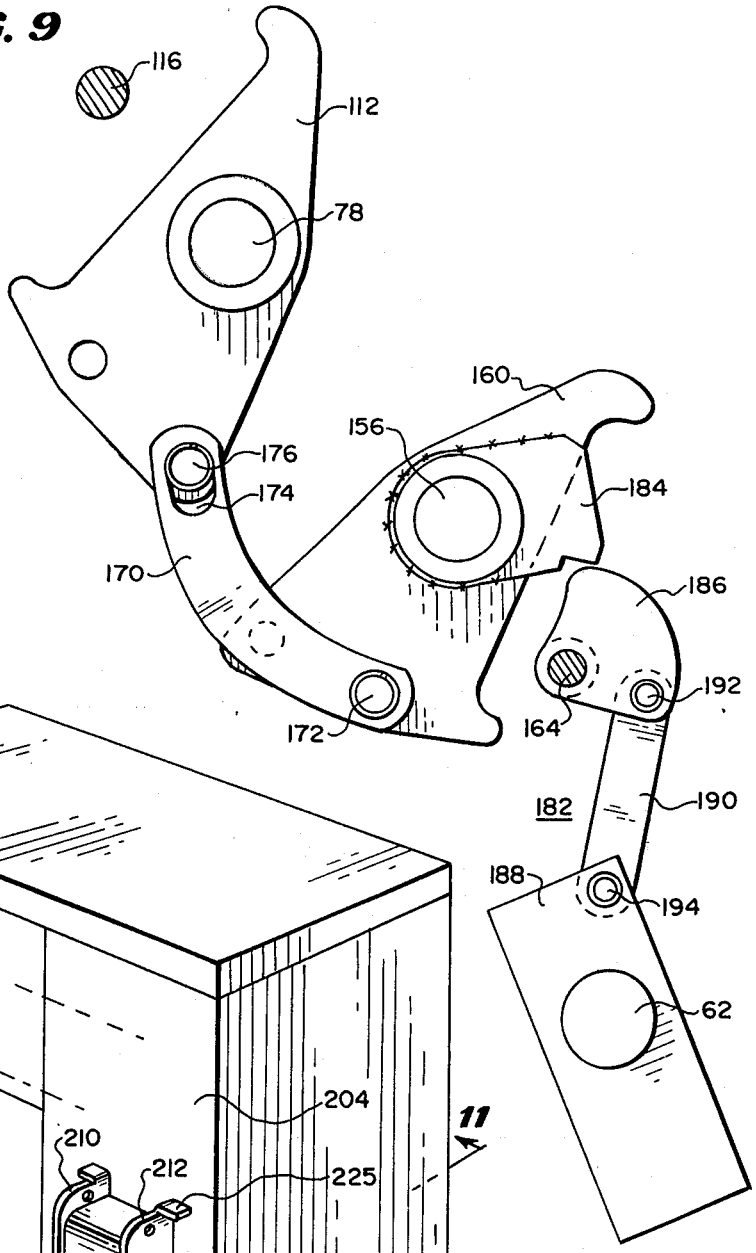

During a manual opening operation of the vacuum interrupter and disconnect switch combination 10, if the welds between the arcing contacts of one or more vacuum interrupters 40 are not broken, or if there is a malfunction of the manual tripping mechanism, it is possible for the vacuum interrupters 40 to remain closed even though the interrupter manual operating shaft 78 has been rotated to its open position. When such a malfunction occurrs, it is possible to inadvertently open the disconnect switch assemblies 34 when the vacuum interrupters 40 are closed. FIGS. 8 and 9 show a mechanical interlock assembly 182 which can be added to the manual operator assembly 166 to prevent opening of the disconnect switch assemblies 34 unless the vacuum interrupters 40 are fully and completely open. The mechanical interlock assembly 182 includes a lever 184 affixed to the manual disconnect operating shaft 156 and to the cam stop plate 160, and a cam latch 186 which is disposed adjacent the lever 184 and is pivotable about the positioning pin 164 in the same plane as the lever 184. The mechanical interlock assembly 182 also includes a lever 188 which is affixed to the interrupter operating shaft 62. The cam latch 186 is connected to the lever 188 by a link 190 having one end pivotably connected to the cam latch 186 by a pivot pin 192, and an opposite end pivotably connected to the lever 188 by another pivot pin 194.

As explained above, when the manual operating handle 168 and the interrupter manual operating shaft 78 are rotated from the closed position towards the open position, the vacuum interrupters 40 are tripped before the manual disconnect operating shaft 156 starts to rotate from its closed position. This is illustrated in FIG. 8, which shows the interrupter manual operating shaft 78 in an intermediate position at which the vacuum interrupters 40 have been tripped and the interrupter operating shaft 62 is in its open position, but the manual disconnect operating shaft 156 and the lever 182 affixed to it are still in their closed position. It can be seen from FIG. 8 that as the interrupter operating shaft 78 is further rotated clockwise to its closed position, lever 184 will be freely rotated clockwise past the cam latch 186 to its closed position.

When the vacuum interrupters 40 are closed, the cam latch 186 is rotated by the link 190 so that it extends into the path of travel of the lever 184. If the vacuum interrupters 40 do not open during a manual opening operation due to contact welding or malfunction of the trip mechanism, when the lever 184 is rotated clockwise, it will strike against the cam lever 186 which prevents any further clockwise rotation of the manual disconnect operating shaft 156. The clockwise rotation of the manual disconnect operating shaft 156 will be stopped by the cam latch 186 before the disconnect switch assemblies 34 start to open. When the vacuum interrupters 40 are closed, the link 190 is moved through its toggle point at which the pivot pins 192 and 194 and the interrupter operating shaft 62 are aligned to its closed position, as shown in FIG. 9. Consequently, when the vacuum interrupters 40 are tripped, the pivot pin 194 is rotated clockwise for at least twice the angular displacement of the pin 194 from the position of the pin 194 when the link 190 is disposed in its toggle position before the cam latch 186 starts to rotate clockwise away from its fully closed position. Thus, the cam latch 186 is only rotated from its fully closed position toward the end of the opening stroke of the vacuum interrupters 40. This linkage arrangement assures that, unless the vacuum interrupters 40 are completely and fully open, the disconnect operating mechanism 18 will be positively locked and the disconnect assemblies 34 will be prevented from opening.

As seen in FIG. 8, when the lever 184 is disposed in its fully closed position, it is sufficently spaced from the cam latch 186 to assure that, when the interrupter manual operating shaft 78 is rotated counterclockwise from its open position to its closed position, the lever 184 will be rotated counterclockwise past the cam latch 186 before the vacuum interrupters 40 are tripped.

Figure 10:
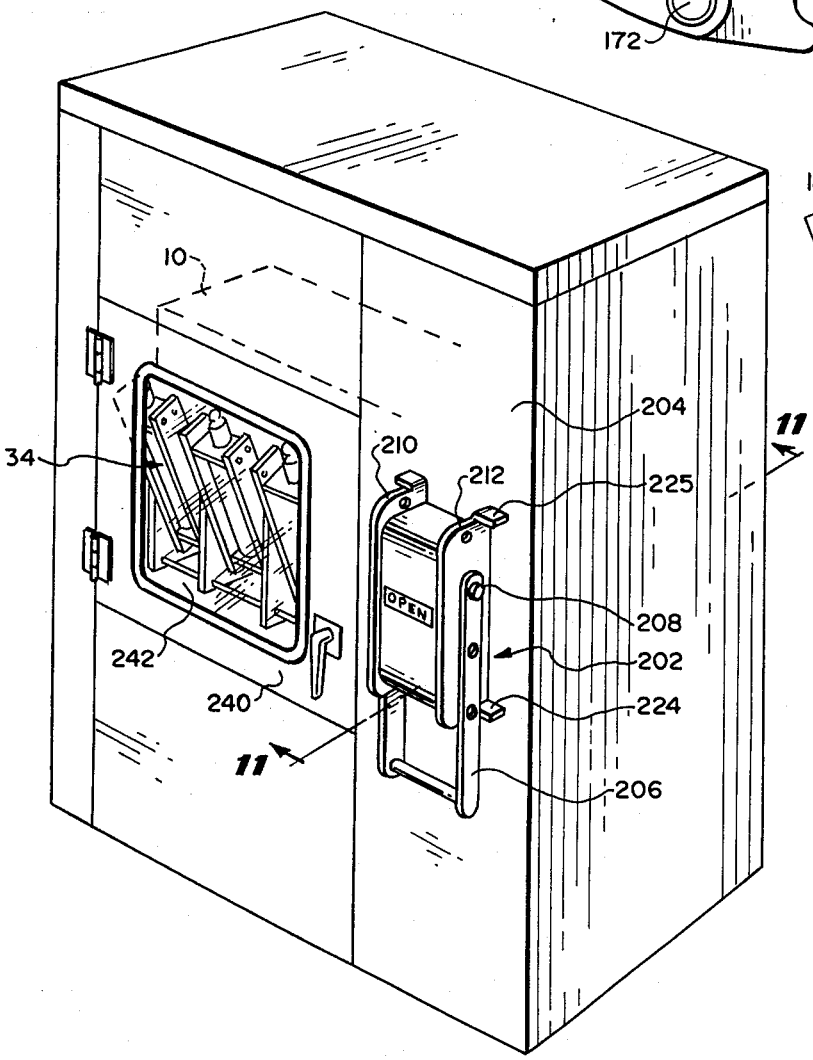
FIG. 10 is a perspective view of a metalclad switchgear enclosure, having a three vacuum interrupter and disconnect switch combination mounted therein, and showing the front housing of a front operated, single handle manual operator assembly for the vacuum interrupter and disconnect switch combination, according to the invention.
Figure 11:
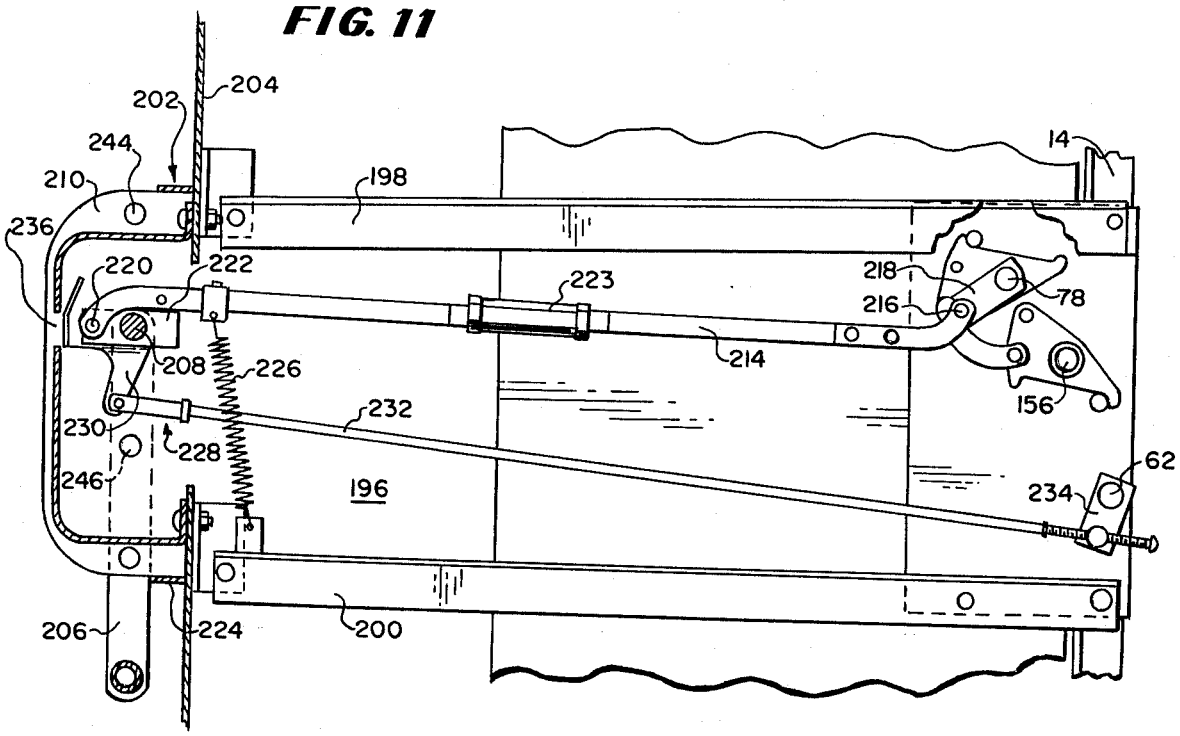
FIG. 11 is a cross-sectional view of the front operated single handle manual operator assembly, taken along the line 11—11 of FIG. 10, showing the operator assembly in its open position.
Figure 12:
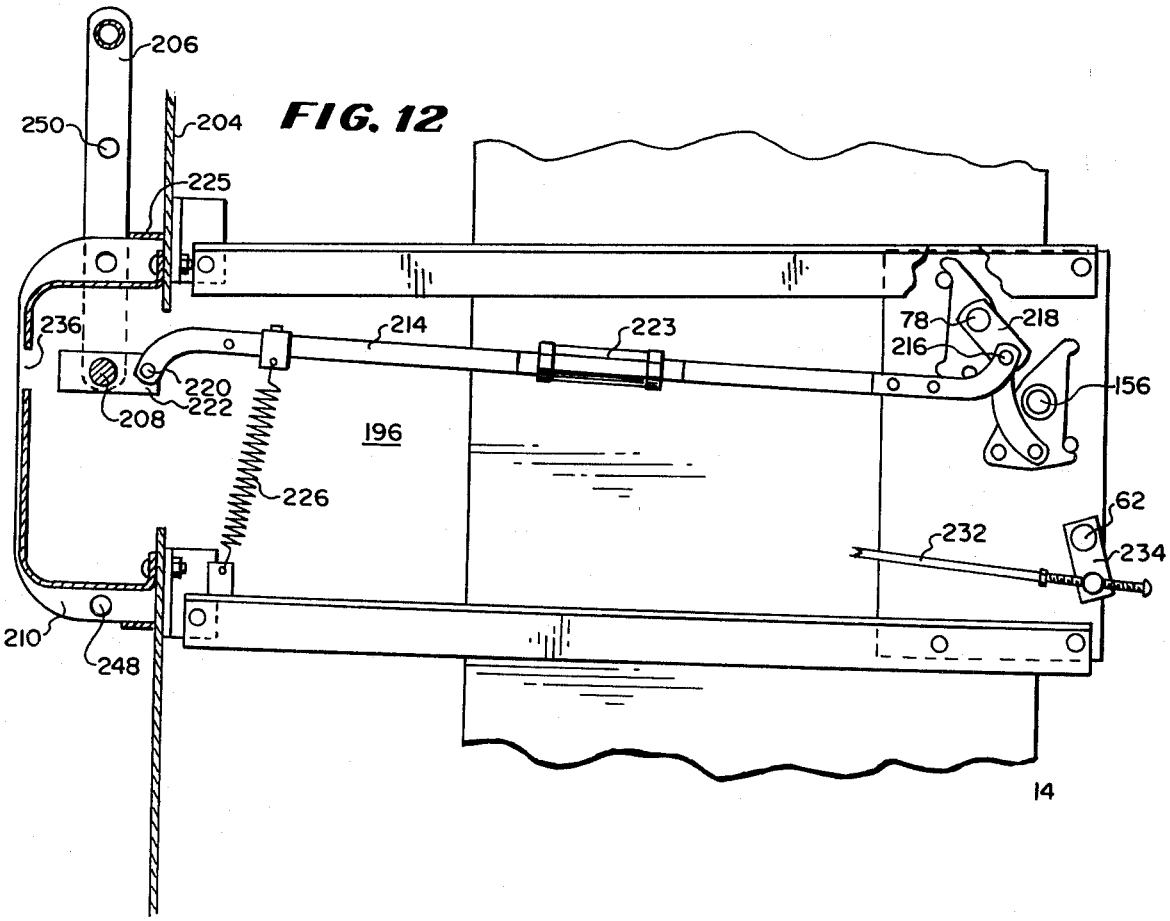
FIG. 12 is a cross-sectional view of the front operated single handle manual operator assembly, similar to FIG. 11 except showing the operator assembly in its closed position.

When the vacuum interrupter and disconnect switch combination 10 is mounted in a metalclad switchgear enclosure, the manual operating handle 168 can be replaced by a front mounted operating handle assembly 196 shown in FIGS. 10, 11 and 12. The operating handle assembly 196 includes a top support member 198 and a bottom support member 200 which are each secured at one end to the support frame 14. A front housing 202 has a back portion which is secured to the top and bottom support members 198, 200, and a front portion which extends through an opening in a front panel 204 of a switchgear enclosure. A double-sided manual operating handle 206 is affixed to both ends of a shaft 208 which extends through, and is pivotably supported by, two vertical side plates 210 and 212 of the front housing 202. One end of an operating rod 214 is pivotably connected by a pin 216 to a lever 218 affixed to the interrupter manual operating shaft 78. An opposite end of the operating rod 214 is pivotably connected by a pin 220 to a lever 222 affixed to the shaft 208. The operating rod 214 includes a turnbuckle 223 for adjusting the length of the operating rod 214. When the interrupter manual operating shaft 78 is in its open position, the lever 222 will extend toward the front of the front housing 202 and the operating rod 214 will be disposed at one of its toggle positions at which the pivot pin 220 is aligned with the shaft 208 and the pivot pin 216, as shown in FIG. 11. Two tabs 224, which extend horizontally from the bottom ends of the side plates 210 and 212, into the path of the manual operating handle 206, prevents the manual operating handle 206 from being rotated counterclockwise from its open position. The pins 216 and 220 are disposed on the levers 218 and 222 respectively so that when the manual operating handle 206 attached to the shaft 208 is rotated approximately 180 degrees in a clockwise direction from its open position, the interrupter manual operating shaft 78 will be rotated approximately 100 degrees from its open position to its closed position, at which the operating rod 214 will be disposed in its other toggle position where the pivot pin 220 is again aligned with the shaft 208 and the pin 216, as shown in FIG. 12. Two tabs 225, which extend horizontally from the top ends of the side plates 210 and 212 into the path of the manual operating handle 206, prevents the manual operating handle from being rotated clockwise from its closed position.

The operating handle assembly 196 also includes an extension spring 226 connected between the front end of the operating rod 214 and the bottom support member 200 which exerts a downward force on the rod 214 at right angles to the rod 214 when the manual operating handle 206 is disposed half way between its open and its closed position. The extension spring 226 exerts a downward force on the operating rod 214 when the manual operating handle 206 is in its open position to hold the manual operating handle 206 against the tab 224 and maintain the operating rod 214 in its toggle position, as shown in FIG. 11. Similarly, the extension spring 226 exerts a downward force on the operating rod 214 when the manual operating handle 206 is in its closed position to hold the manual operating handle 206 against the tab 225 and thus maintain the operating rod 214 in its other toggle position, as shown in FIG. 12.

The operating handle assembly 196 also includes an interrupter contact position indicator 228. A bell crank 230, pivotably mounted to the shaft 208, has one arm which is pivotably connected to an operating rod 232. The opposite end of the operating rod 232 is pivotably connect to a lever 234 affixed to the interrupter operating shaft 62. The other arm of the bell crank 230 carries a red "CLOSED" sign and a green "OPEN" sign, one of which can be viewed from the front through an opening 236 of the front housing 202. When the contacts of the vacuum interrupters 40 are closed, the red "CLOSED" sign can be viewed by an operator through the opening 236. When the contacts of the vacuum interrupters 40 are open, the green "OPEN" sign can be viewed by the operator through the opening 236. Also, as shown in FIG. 10, the switchgear enclosure front panel 204 includes an access door 240 having a window 242 through which the open or closed position of the disconnect switch assemblies 34 can be view by an operator.

The vertical side plate 210 of the front housing 202 includes a hole 244 adjacent its top end which is aligned with a hole 246 in the manual operating handle 206 when the manual operating handle 206 is in its closed position, so that a padlock can be inserted through the aligned holes 244, 246 to lock the manual operating handle 206 in its closed position. Similarly, the vertical side plate 210 includes another hole 248 adjacent its bottom end which is aligned with a hole 250 in the manual operating handle 206 when the manual operating handle 206 is in its open position, so that a padlock can be inserted through the aligned holes 248 and 250 to lock the manual operating handle 206 in its open position.

Figure 13:
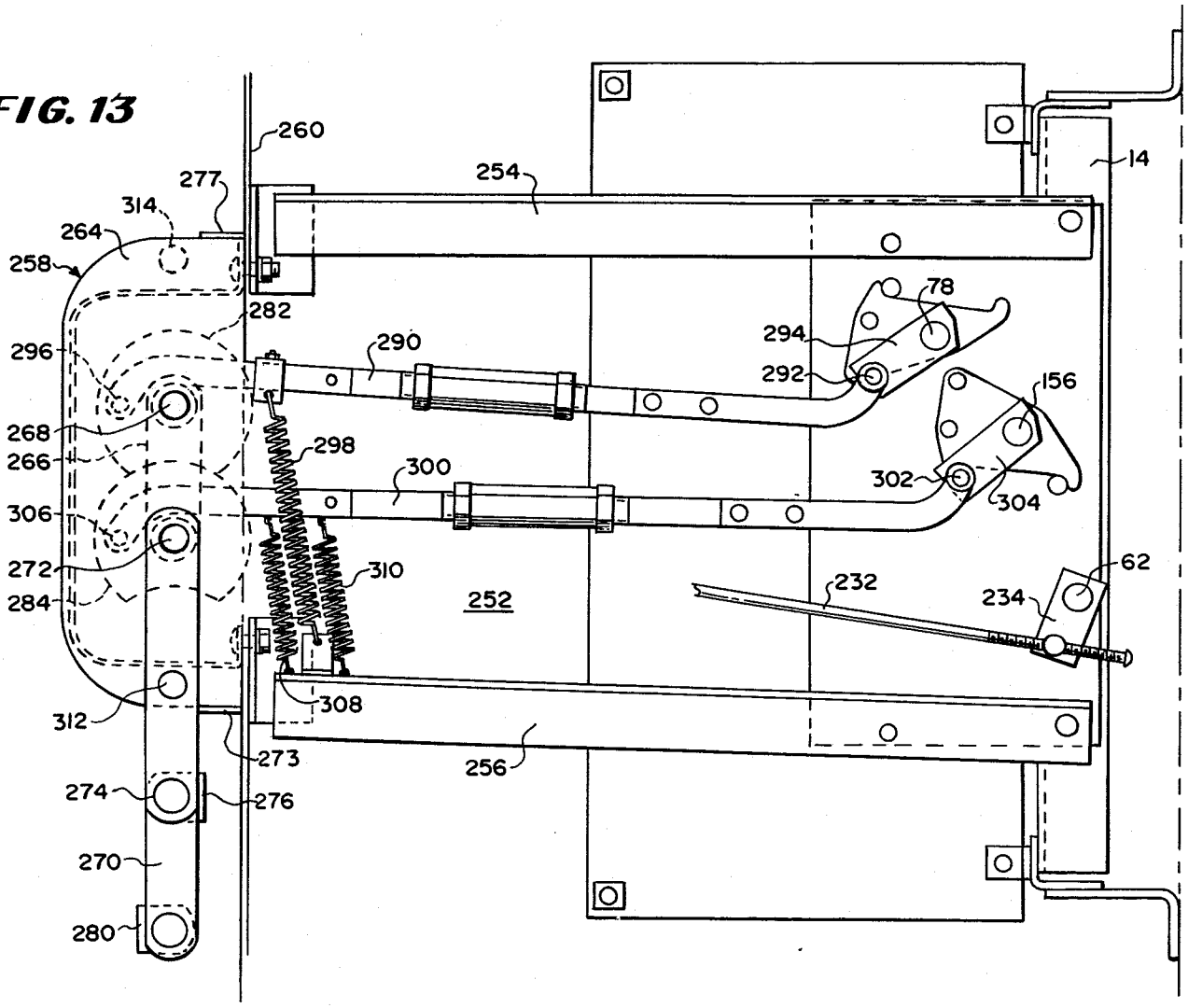
FIG. 13 is a cross-sectional side view of a two handle, front operated manual operator assembly, known prior to the invention described herein.
Figure 14:
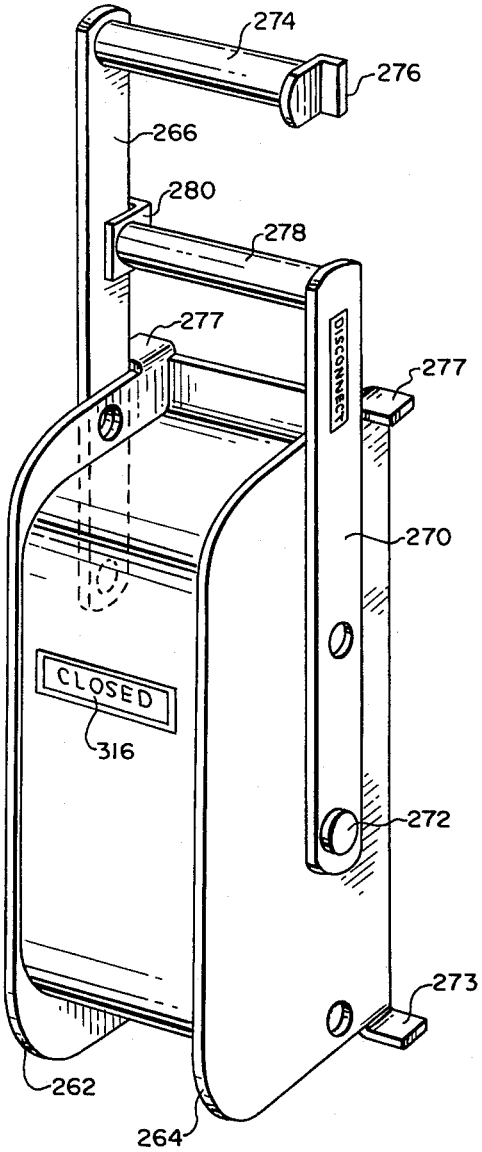
FIG. 14 is a perspective view of the front housing of the two handle, front operated, manual operator assembly of FIG. 13, with the interruper manual operating handle and the disconnect manual operating handle both shown in their closed positions.

FIG. 13 shows a two-handle, front-mounted, manual operator assembly 252 for manually operating a vacuum interrupter and disconnect switch combination 10 which is vertically mounted within a switchgear enclosure. The manual operating assembly 252 includes a top support member 254 and a bottom support member 256 which are each mounted at one end to the common support frame 14. A front housing 258 has a back portion which is mounted to the top and bottom support members 254 and 256, and a front portion which extends through an opening in the front panel 260 of a metalclad switchgear enclosure. The front housing 258, also shown in FIG. 14, includes two spaced apart vertical side plates 262 and 264. An interrupter manual operating handle 266, adjacent the vertical side plate 262, is fasten at one end to a shaft 268 which extends through, and is pivotably supported by, the vertical side plates 262 and 264. A disconnect manual operating handle 270, disposed adjacent the vertical side plate 264, is fastened at one end to a shaft 272 which extends through, and is pivotably supported by, the two vertical side plates 262 and 264. Two tabs 273, which extend horizontally from the bottom ends of the side plates 262 and 264 into the paths of the interrupter manual operating handle 266 and the disconnect manual operating handle 270, serve to position the manual operating handles 266 and 270 in their open positions, as shown in FIG. 13. Also, a horizontally extending, tubular hand grip member 274, which is affixed to the free end of the interrupter manual operating handle 266, carries a tab 276 which extends behind the disconnect operating handle 270 when both of the manual operating handles 266 and 270 are disposed in their open position. Two tabs 277, which extend horizontally from the top ends of the side plates 262 and 264 into the paths of the interrupter manual operating handle 266 and the disconnect manual operating handle 270, serve to position the manual operating handles 266 and 270 in their closed positions, as shown in FIG. 14. Another horizontally extending tubular hand grip member 278, affixed to the free end of the disconnect operating handle 270, carries a tab 280 which extends behind the interrupter manual operating handle 266 when both of these manual operating handles 266 and 270 are in their closed position.

Figure 15:
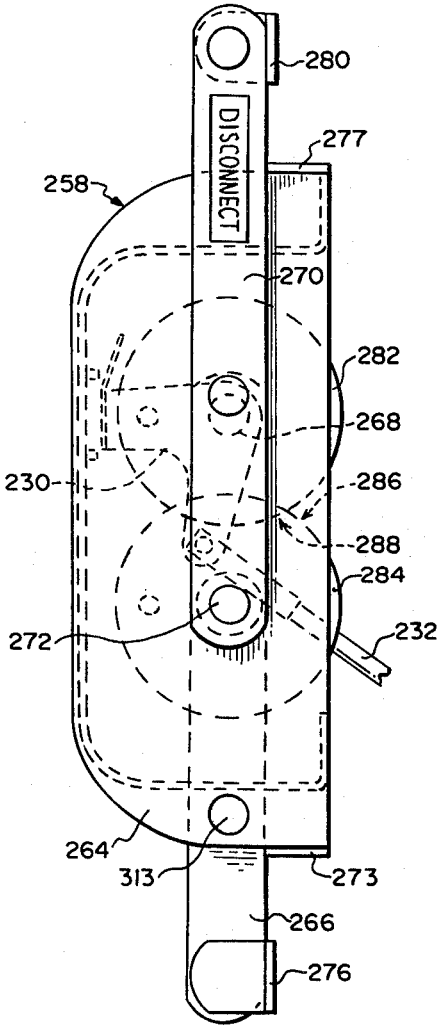
FIG. 15 is a side view of the front housing shown in FIG. 14, with the interrupter manual operating handle shown in its open position and the disconnect manual operating handle shown in its closed position.

Two interlocking disks 282 and 284, similar to the interlocking disks described in the above-referenced U.S. Pat. No. 4,105,878, are mounted on the shafts 268 and 272 respectively, in a plane orthogonal to the axis of the shafts 268 and 272. The diameter of each interlocking disk 282, 284 is greater than the centerline distance between the two shafts 268 and 272. The disks 282 and 284 are orientated so that when the interrupter manual operating handle 266 is in its open position and the disconnect manual operating handle 270 is in its closed position, a semicircular indent 286 of the disk 282 and a similar semicircular indent 288 of the disk 284 face one another and symmetrically intersect the plane extending between the axis of the shafts 268 and 272, as shown in FIG. 15. With such an orientation of the disks 282 and 284, the disconnect operating mechanism 18 can only be operated when the vacuum interrupters 40 have been tripped and the interrupter manual operating handle 266 is in its open position, and the disconnect switch assemblies 34 must be closed before the vacuum interrupters 40 can be closed. This assures that the disconnect contacts 30, 42 can never interrupt or close an energized circuit.

The manual operator assembly 252 includes an operating rod 290, similar to the operating rod 214 of the operating handle assembly 196. One end of the operating rod 290 is connected by a pin 292 to a lever 294, which is similar to the lever 218 of the operating handle assembly 196 and which is affixed to the interrupter manual operating shaft 78. The opposite end of the operating rod 290 is pivotably connected by a pin 296 to the disk 282, in the same manner as the operating rod 214 is pivotably connected to the lever 222 of the operating handle assembly 196. An extension spring 298, similar to the extension spring 226, has one end attached to the operating rod 290 and an opposite end attached to the front end of the bottom support member 256, to exert a downward force on the end of the operating rod 290 adjacent the disk 282. When the interrupter manual operating handle 266 is disposed in its open position, as shown in FIG. 13, the operating rod 290 is held in a toggle position by the extension spring 298. When the interrupter manual operating handle 266 is rotated 180 degrees clockwise to its closed position, the operating rod 290 is again held in a toggle position by the extension spring 298.

The manual operator's assembly 252 includes a second operating rod 300, similar to the operating rod 214 of the operating handle assembly 196. One end of the operating rod 300 is pivotably connected by a pin 302 to a lever 304, which is similar to the lever 218 of the operating handle assembly 196 and which is affixed to the manual disconnect operating shaft 156. An opposite end of the operating rod 300 is pivotably connected by a pin 306 to the disk 284. Two extension springs 308 and 310 are connected at one end to the operating rod 300 and at an opposite end to the front end of the bottom support member 256 to exert a downward force on the end of the operating rod 300 adjacent the disk 284. When the disconnect manual operating handle 270 is in its open position, as shown in FIG. 13, the extension spring 308 and 310 exert a force on the operating rod 300 to hold the operating rod 300 in a toggle position at which the axis of the pin 284, the shaft 272, and the pin 302 are disposed along a straight line. When the disconnect manual operating handle 270 is rotated 180 degrees clockwise to its closed position the extension springs 308 and 310 exert a force on the operating rod 300 to maintain the operating rod 300 in its other toggle position.

When the interrupter manual operating handle 266 and the disconnect manual operating handle 270 are disposed in their open positions, a hole 312 in the disconnect manual operating handle 270 is aligned with a hole 313 through an extending bottom edge of the vertical side plate 264, so that hasp of a padlock can be inserted through these two aligned holes to lock the disconnect manual operating handle 270 in its open position. This padlock will also lock the interrupter manual operating handle 266 in its open position, since the tab 276 of the interrupter manual operating handle 266 prevents the interrupter operating handle 266 from being rotated from its open position when the disconnect operating handle 270 is locked in its open position.

Similarly, the interrupter manual operating handle 266 includes a hole therethrough (not shown) which is aligned with a hole 314 through the extended upper end of the vertical side plate 262 when the interrupter manual operating handle 266 is disposed in its closed position. When both the interrupter manual operating handle 266 and the disconnect manual operating handle 270 are disposed in their closed position, the hasp of a padlock may be inserted through the two aligned holes to lock the interrupter manual operating handle 266 in its closed position. The disconnect manual operating handle 270 will also be locked in its closed position since the tab 280 of the disconnect manual operating handle 270 prevents the disconnect manual operating handle 270 from being rotated from its closed position when the interrupter manual operating handle 266 is locked in its closed position.

The manual operator assembly 252 also includes the interrupter contact position indicator 228 discussed above and shown in FIG. 11, in which the bell crank 230 of the interrupter contact position indicator 228 is pivotably mounted to the shaft 268 so that the "OPEN" or "CLOSED" signs carried on the end of one arm of the bell crank 230 can be viewed by an operator through an opening 316 in the front side of the housing 258. The manual operator assembly 252 may also include the mechanical interlock assembly 182, discussed above and shown in FIGS. 8 and 9, to prevent opening of the disconnect switch assembly 34 unless the vacuum interrupter 40 are fully and completely open.

The present disclosure includes that contained in the appended claims as well as that of the foregoing description. Thus, it is understood that various changes, modifications, or adaptations can be made to the embodiments of the invention described herein without departing from the spirit and scope of the invention as hereinafter claimed.

What is claimed is:

1. A circuit interrupter and disconnect switch combination, which comprises:

a support structure;

a first operating shaft, having a longitudinal axis, which is rotatably mounted to the support structure of rotation about its longitudinal axis between an open and a closed position;

a circuit interrupter mounted to the support structure and including a first electrically conductive interrupting contact member and a second electrically conductive interrupting contact which is movable relative to the first interrupting contact member between a closed position at which the second interrupter contact member engages the first interrupter contact member, and an open position at which the second interrupter contact member is disengaged and spaced from the first interrupting contact member;

an interrupter operating shaft, having a longitudinal axis, which is rotatably mounted to the support structure in spaced parallel arrangement with the first shaft for rotation about its longitudinal axis between a closed position and an open position;

interrupter connecting means, disposed between the second contact member of the circuit interrupter and the interrupter operating shaft, for moving the second contact member to its closed position when the interrupter operating shaft is rotated to its closed position, and for moving the second contact member to its open position when the interrupter operating shaft is rotated and its open position;

an interrupter operating means, connected between the first shaft and the interrupter operating shaft, for quickly rotating the interrupter operating shaft between its open and closed positions, wherein, as the first shaft is rotated from its open position toward its closed position, the interrupter operating means quickly rotates the interrupter operating shaft from its open position to its closed position at a first intermediate position of the first shaft near the closed position of the first shaft, and wherein, as the first shaft is rotated from its closed position toward its open position, the interrupter operating means quickly rotates the interrupter operating shaft from its closed position to its open position at a second intermediate position of the first shaft near the closed position of the first shaft;

a disconnect switch which is mounted to the support structure, and which includes a first electrically conductive disconnect contact member, and a second electrically conductive disconnect contact member which is movable relative to the first disconnect contact member between a closed position at which the second disconnect contact member engages the first disconnect contact member, and an open position at which the second disconnect contact member is disengaged and spaced from the first disconnect contact member, one of the disconnect contact members being electrically connected to one of the interrupting contact members of the circuit interrupter;

a disconnect operating shaft, having a longitudinal axis, which is rotatably mounted to the support structure for rotation about its longitudinal axis between a closed position and an open position, in spaced parallel arrangement with the interrupter operating shaft;

connecting means, disposed between the second disconnect contact member and the disconnect operating shaft, for moving the second disconnect contact member to its closed position when the disconnect operating shaft is rotated to its closed position, and moving the second disconnect contact member to its open position when the disconnect operating shaft is rotated to its open position;

a first lever affixed to the first shaft;

a second lever affixed to the disconnect operating shaft;

a driving link for connecting the disconnect operating shaft to be rotated between its open and closed positions as the first shaft is rotated between its corresponding open and closed positions, the driving link having a first end which is pivotally connected to one of the first and second levers, and an opposite second end which defines an elongated opening, or slot, through the driving link having an outer end and an inner end which define the length of the slot;

a pivot pin, carried by the other of the first and second levers, which extends through the slot of the driving link, the pin being disposed against one of the outer and inner ends of the slot when the first shaft is disposed in its open position, and the driving link being moved over and beyond a toggle position when the first shaft is rotated to its closed position;

wherein, as the first shaft is rotated from its open position towards its closed position, the pivot pin traverses the length of the slot and abuts against the other of the outer and inner ends of the slot to initiate the rotation of the disconnect operating shaft from its open position towards its closed position, the pivot pin remaining in abuttment with the other end of the slot until the driving link has been moved to its toggle position, the second disconnect contact member engaging the first disconnect contact member at a third intermediate position of the first shaft before the driving link has been moved to its toggle position, and before the interrupter operating shaft has been rotated from its open position to its closed position by the interrupter operating means at the first intermediate position of the first shaft which is disposed between the third intermediate position and the closed position of the first shaft; and wherein, as the first shaft is rotated from its closed position towards its open position, the driving link is moved over its toggle position and the pivot pin is moved the length of the slot and abuts against the one side of the slot to initiate rotation of the disconnect operating shaft from its closed position towards its open position at a fourth intermediate position of the first shaft, the interrupter operating shaft being rotated from its closed position to its open position at the second intermediate position of the first shaft at which the first shaft is disposed between its closed position and its fourth intermediate position;

whereby, when the second operating shaft is rotated from its closed position to its open position, the series circuit through the circuit interrupter and the disconnect switch is opened by the circuit interrupter before the disconnect switch opens, and, when the second shaft is rotated from its open position to its closed position, the disconnect switch closes before the circuit interrupter closes.

2. A circuit interrupter and disconnect switch combination, as described in claim 1, wherein the disconnect connecting means comprises:

a third lever affixed to the disconnect operating shaft;

an elongated disconnect support member, having one end to which the second disconnect contact member is affixed, and an opposite end which is pivotally mounted to the support structure for rotation between a closed position at which the second disconnect contact member engages the first disconnect contact member, and an open position at which the second disconnect member is disengaged and spaced from the first disconnect contact member;

a connecting link, having one end which is pivotally connected to the third lever and an opposite end which is pivotally connected to the disconnect support member intermediate the ends of the disconnect support member, the connecting link being disposed in an overtoggled position when the disconnect operating shaft and the disconnect support member are disposed in their closed positions;

whereby, when the disconnect operating shaft is rotated from its closed position towards its open position, the disconnect support member will not start to rotate from its closed position towards its open position until the disconnect operating shaft has rotated at least twice the angular displacement between the closed position of the disconnect operating shaft and the position of the disconnect operating shaft at which the connecting link is disposed in its toggle position.

3. A circuit interrupter and disconnect switch combination, as described in claim 1, which further comprises disconnect latching means for latching the disconnect operating shaft in its open position whenever the first shaft is disposed in its open position, the disconnect latching means being released when the first shaft is rotated from its open position towards its closed position, before the pivot pin affixed to one of the first and second levers has been moved the length of the slot from its open position adjacent one end of the slot.

4. A circuit interrupter and disconnect switch combination, as described in claim 1, which includes a mechanical interlocking means for preventing the second disconnect contact member from being moved from its closed position unless the second interrupter contact member is disposed in its opened position, wherein the mechanical interlocking means comprises:

a third lever affixed to the disconnect operating shaft;

a cam latch, disposed adjacent the third lever, which is pivotally mounted to the support structure for rotation about an axis parallel to the axis of the disconnect operating shaft in the same plane as the third lever;

a fourth lever, affixed to the interrupter operating shaft; and a connecting link, having one end pivotally connected to the fourth lever and an opposite end pivotally connected to the cam latch, wherein, when the interrupter operating shaft is disposed in its open position, the third lever is freely rotatable from its open position past the cam latch to its closed position, and, when the interrupter operating shaft is disposed in its closed position or a position intermediate its closed and open positions, the cam latch extends into the path of travel of the third lever, so that when the first shaft is rotated from its closed position towards its open position, the third lever will abut against the cam latch at a position of the first shaft intermediate the second intermediate position of the first shaft at which the interrupter operator shaft is rotated to its open position and the position of the first shaft at which the second disconnect contact member starts to disengage from the first disconnect contact member.

5. A circuit interrupter and disconnect switch combination, as described in claim 1, which further comprises:

a second operating shaft, having a longitudinal axis, which is rotatably mounted to the support structure in spaced parallel arrangement with the first shaft for rotation abouts its longitudinal axis in a first direction from an open position to a closed position, and for rotation abouts its longitudinal axis in an opposite second direction from its closed position to its open position;

restraining means for limiting the angular rotation of the second shaft by preventing rotation of the second shaft from its closed position in the first direction and by preventing rotation of the second shaft from its open position in the second direction;

the first lever affixed to the first shaft;

a second lever affixed to the second shaft;

an operating rod, which has a first end pivotally connected to the first lever and a second end pivotally connected to the second lever, wherein when the second shaft is disposed in its open position, the first shaft is disposed in its open position and the operating rod is disposed at a first toggle position, and wherein when the second shaft is rotated from its open position to its closed position, the first shaft is rotated from its open position to its closed position and the operating rod is moved from its first toggle position to a second toggle position; and spring means, connected between the operating rod and the support structure, for exerting a force on the operating rod to maintain the operating rod at one of its first and second toggle positions, wherein the force exerted by the spring means on the operating rod increases, as the operating rod is moved from either its first or second toggle positions, to a maximum value at a position of the operating rod intermediate its first and second toggle positions.

6. A circuit interrupter and disconnect switch combination, as described in claim 1, wherein the interrupter operating means comprises:

opening spring means for biasing the interrupter operating shaft towards its open position;

an operating lever affixed to the interrupter operating shaft;

a latch lever, rotatably mounted for rotation about the first shaft axis between a closed position and an open position;

closing spring means, connected between the latch lever and the first shaft, for biasing the latch lever towards a corresponding position of the first shaft;

first releasable latching means for holding the latch lever in its open position as the first shaft is rotated from its open position towards its closed position, against the bias force of the closing spring means;

first latch release means for releasing the first latching means as the first shaft is rotated towards its closed position, at the first intermediate position of the first shaft, at which the closing spring means is fully charged;

a second releasable latching means for holding the latch lever in its closed position when the interrupter operating shaft is in its closed position;

second latch release means for releasing the second latching means when the first shaft is rotated from its closed position towards its open position, at the second intermediate position of the first shaft;

a collapsible toggle linkage assembly which includes a first elongated member, a second elongated member pivotally connected to the first member for rotation about the first member between an extended position and a retracted, or collapsed, position of the linkage assembly, and a releasable tip latch means for holding the first and second members in the extended position, one end of the first member being pivotally connected to the operating lever affixed to the interrupter operating shaft and an opposite end of the second member being pivotally connected to the latch lever, such that when the latch lever is in its open position, the toggle linkage assembly is in its extended latched position and the interrupter operating shaft is in its open position, and when the latch lever is in its closed position and the linkage assembly in its extended latched position, the interrupter operating shaft is in its closed position; and trip latch releasing means for unlatching the linkage assembly only when the interrupter operating shaft is in its closed position, the trip latch releasing means being actuated by the rotation of the first shaft from its closed position towards its open position.

7. A circuit interrupter and disconnect switch combination, which comprises:

a support structure;

a first operating shaft, having a longitudinal axis, which is rotatably mounted to the support structure of rotation about its longitudinal axis between an open and a closed position;

a circuit interrupter mounted to the support structure and including a first electrically conductive interrupting contact member and a second electrically conductive interrupting contact which is movable relative to the first interrupting contact member between a closed position at which the second interrupter contact member engages the first interrupter contact member, and an open position at which the second interrupter contact member is disengaged and spaced from the first interrupting contact member;

an interrupter operating shaft, having a longitudinal axis, which is rotatably mounted to the support structure in spaced parallel arrangement with the first shaft for rotation about its longitudinal axis between a closed position and an open position;

interrupter connecting means, disposed between the second contact member of the circuit interrupter and the interrupter operating shaft, for moving the second contact member to its closed position when the interrupter operating shaft is rotated to its closed position, and for moving the second contact member to its open position when the interrupter operating shaft is rotated to its open position;

an interrupter operating means, connected between the first shaft and the interrupter operating shaft, for quickly rotating the interrupter operating shaft between its open and closed positions, wherein, as the first shaft is rotated from its open position toward its closed position, the interrupter operating means quickly rotates the interrupter operating shaft from its open position to its closed position at a first intermediate position of the first shaft near the closed position of the first shaft, and wherein, as the first shaft is rotated from its closed position toward its open position, the interrupter operating means quickly rotates the interrupter operating shaft from its closed position to its open position at a second intermediate position of the first shaft near the closed position of the first shaft;

a disconnect switch which is mounted to the support structure, and which includes a first electrically conductive disconnect contact member, and a second electrically conductive disconnect contact member which is movable relative to the first disconnect contact member between a closed position at which the second disconnect contact member engages the first disconnect contact member, and an open position at which the second disconnect contact member is disengaged and spaced from the first disconnect contact member, one of the disconnect contact members being electrically connected to one of the interrupting contact members of the circuit interrupter;

a disconnect operating shaft, having a longitudinal axis, which is rotatably mounted to the support structure for rotation about its longitudinal axis between a closed position and an open position, in spaced parallel arrangement with the interrupter operating shaft;

connecting means, disposed between the second disconnect contact member and the disconnect operating shaft, for moving the second disconnect contact member to its closed position when the disconnect operating shaft is rotated to its closed position, and moving the second disconnect contact member to its open position when the disconnect operating shaft is rotated to its open position;

a first lever affixed to the disconnect operating shaft;

a cam latch, disposed adjacent the first lever, which is pivotally mounted to the support structure for rotation about an axis parallel to the axis of the disconnect operating shaft in the same plane as the first lever;

a second lever, affixed to the interrupter operating shaft; and a connecting link, having one end pivotally connected to the second lever and an opposite end pivotally connected to the cam latch, wherein, when the interrupter operating shaft is disposed in its open position, the first lever is freely rotatable from its open position past the cam latch to its closed position, and, when the interrupter operating shaft is disposed in its closed position or a position intermediate its closed and open positions, the cam latch extends into the path of travel of the first lever, so that when the first shaft is rotated from its closed position towards its open position, the first lever will abut against the cam latch at a position of the first shaft intermediate the second intermediate position of the first shaft at which the interrupter operator shaft is rotated to its open position and the position of the first shaft at which the second disconnect contact member starts to disengage from the first disconnect contact member.

8. A circuit interrupter and disconnect switch combination, as described in claim 7, which further comprises a second operating shaft, having a longitudinal axis, which is rotatably mounted to the support structure in spaced parallel arrangement with the first shaft for rotation about its longitudinal axis in a first direction from an open position to a closed position, and for rotation about its longitudinal axis in an opposite second direction from its closed position to its open position;

restraining means for limiting the angular rotation of the second shaft by preventing rotation of the second shaft from its closed position in the first direction and by preventing rotation of the second shaft from its open position in the second direction;

the first lever affixed to the first shaft;

a second lever affixed to the second shaft;

an operating rod, which has a first end pivotally connected to the first lever and a second end pivotally connected to the second lever, wherein when the second shaft is disposed in its open position, the first shaft is disposed in its open position and the operating rod is disposed at a first toggle position, and wherein when the second shaft is rotated from its open position to its closed position, the first shaft is rotated from its open position to its closed position and the operating rod is moved from its first toggle position to a second toggle position;

spring means, connected between the operating rod and the support structure, for exerting a force on the operating rod to maintain the operating rod at one of its first and second toggle positions, wherein the force exerted by the spring means on the operating rod increases, as the operating rod is moved from either its first or second toggle positions, to a maximum value at a position of the operating rod intermediate its first and second toggle positions;

a third operating shaft, having a longitudinal axis, which is rotatably mounted to the support structure in spaced, parallel arrangement with the second operating shaft and the disconnect operating shaft, for rotation about its longitudinal axis in a first direction from an open position to a closed position, and for rotation about its longitudinal axis in an opposite second direction from its closed position to its open position;

second restraining means for limiting the angular position of the third shaft by preventing rotation of the third shaft from its closed position in its first direction of rotation and by preventing rotation of the third shaft from its open position in its second direction of rotation;

a third lever affixed to the disconnect operating shaft;

a fourth lever affixed to the third shaft, a second operating rod, which has a first end pivotally connected to the third lever and a second end pivotally connected to a second lever, wherein when the third shaft is disposed in its open position, the disconnect operating shaft is disposed in its open position and the second operating rod is disposed at a first toggle position, and wherein when the third shaft is rotated from its open position to its closed position, the disconnect operating shaft is rotated from its open position to its closed position and the second operating rod is moved from its first toggled position to a second toggle position;

second spring means, connected between the second operating rod and the support structure, for exerting a force on the second operating rod to maintain the second operating rod at one of its first and second toggle positions, wherein the force exerted by the second spring means on the second operating rod increases, as the second operating rod is moved from either its first or second toggle positions, to a maximum value at a position of the second operating rod intermediate its first and second toggle positions;

first interlock means for allowing the rotation of the third shaft only when the second shaft is in its open position; and second interlock means for allowing the rotation of the second shaft only when the third shaft is in its closed position.

9. An interrupter and disconnect combination, as described in claim 8, wherein said first and second interlock means comprise:

first and second interlocking disks carried by the second and third shaft, respectively, and disposed opposite one another in a plane orthogonal to the axes of rotation of the second and third shafts, the sum of the radii of the two disks being greater than a centerline distance between the second shaft and the third shaft, each disk defining a semicircular recessed portion of its periphery whose shape closely conforms with the circular shape of the other interlocking disk when said semicircular recessed portion is facing the other disk, the first disk being disposed on the second shaft so that the semicircular recessed portion of its periphery faces the second disk only when the second shaft is in its closed position, and the second disk being disposed on the third shaft so that the semicircular recessed portion of its periphery faces the first disk only when the third shaft is in its open position.

* * * * *